United States Patent [19]

Giacin

[11] 4,153,230

[45] May 8, 1979

[54] BABY BUMPERS

[76] Inventor: Terry L. Giacin, c/o Paul E. Wade, 1884 Edgewater Dr., Cincinnati, Ohio 45239

[21] Appl. No.: 795,197

[22] Filed: May 9, 1977

[51] Int. Cl.[2] ..... A47B 97/00; A47D 15/00

[52] U.S. Cl. ..... 248/345.1; 52/822; 229/DIG. 1; 428/83; 428/542

[58] Field of Search ..... 428/13, 14, 542, 81, 428/122, 31, 83; 248/345.1; 206/326; 229/DIG. 1; 49/462; 52/624, 627, 288, 822; 108/27

[56] References Cited

U.S. PATENT DOCUMENTS

| | | | |
|---|---|---|---|
| 459,251 | 9/1891 | Hall | 248/345.1 |
| 1,936,113 | 11/1933 | Jeliffe | 248/345.1 X |
| 2,166,798 | 7/1939 | Cote | 248/345.1 X |
| 2,826,240 | 3/1958 | Meier et al. | 428/81 |
| 2,975,092 | 3/1961 | Hagerty | 156/252 X |
| 3,049,260 | 8/1962 | Stone | 229/DIG. 1 |
| 3,150,854 | 9/1964 | Jamieson | 248/345.1 |
| 3,233,644 | 2/1966 | Bono | 108/27 X |
| 3,298,374 | 1/1967 | Grundell | 428/122 X |
| 3,523,710 | 8/1970 | Barecki et al. | 428/81 X |
| 3,627,251 | 12/1971 | Paulison | 248/345.1 |
| 3,680,903 | 8/1972 | Hulten | 49/462 X |
| 3,869,106 | 3/1975 | Gregov | 428/81 X |

*Primary Examiner*—Henry F. Epstein

[57] ABSTRACT

A safety bumper for furniture, in order to protect young children, as well as old or handicapped persons, from becoming injured if falling upon sharp edges of furniture; the device consisting generally of a stretchable rubber bead that snaps-fits around the periphery of any shaped furniture top edge, and which includes horizontal flaps for extending over the top, and a vertical flap for extending adjacent the side of the furniture, the bead at its corners additionally including a spherical shaped protrusion, for additional impact shock absorption.

2 Claims, 8 Drawing Figures

BABY BUMPERS

This invention relates generally to safety bumpers for furniture.

It is generally well known to most persons, that small children, learning to walk, are subject to falling often, and sometimes hurting their heads, chins or eyes upon sharp edges of furniture, such as tables, footstools, coffee tables and the like. Also, upon occasion, elderly or handicapped people tend to lose their balance, so that they, likewise, can fall and become injured, by striking against hard sharp edges of the above described furniture. This situation is, of course, serious, and is, therefore, in want of an improvement.

Accordingly, it is the principal object of the present invention to provide baby bumpers which comprise a soft resilient beading, that surrounds the peripheries of furniture such as coffee tables, end tables and the like, so that a child or person striking thereagainst is cushioned from injury.

Another object of the present invention is to provide baby bumpers, which can be quickly and easily mounted around any furniture, because the same is stretchable, so that it simply fits around the furniture periphery.

Still another object of the present invention is to provide a baby bumper, which, by simply stretching around the edges of the furniture, will not destroy the finish, or mar the furniture in any manner.

Still another object is to provide a baby bumper, which, after no longer being needed for use, can be easily unsnapped off the furniture in a quick and easy manner, and leave no unsightly mark behind on the furniture item.

Yet a further object is to provide baby bumpers, which can be re-used again and again.

Other objects are to provide baby bumpers, which are simple in design, inexpensive to manufacture, rugged in construction, easy to use and efficient in operation.

These, and other objects will be readily evident, upon the study of the following specification, and the accompanying drawing, wherein:

FIG. 1 is a perspective view of the present invention, shown partly broken away, so as to illustrate its cross section, and showing it being fitted around a rectangular table;

FIG. 2 is a perspective view of the invention, shown designed for a triangular shaped table;

FIG. 3 is a perspective view, showing a form of the invention designed particularly for round or oval tables, or tables having no corners, the invention being shown partly broken away, so as to illustrate the interior construction thereof;

FIG. 4 is an enlarged cross-section, that is typical of the design used for tables having corners;

FIG. 5 is an enlarged cross-sectional view, that is typical particularly for round tables, and indicating by dotted lines a thicker construction;

FIG. 6 shows a design of the invention for fitting edges of plate glass table tops;

FIG. 7 shows a design of the invention for fitting edges of plate glass table tops that are irregularly shaped, such as kidney shaped coffee tables and the like; and FIG. 8 is an enlarged cross-sectional view, taken on line 8—8 of FIG. 7.

Figures 1, 2, 3, 4, 5, 6, 7, 8:
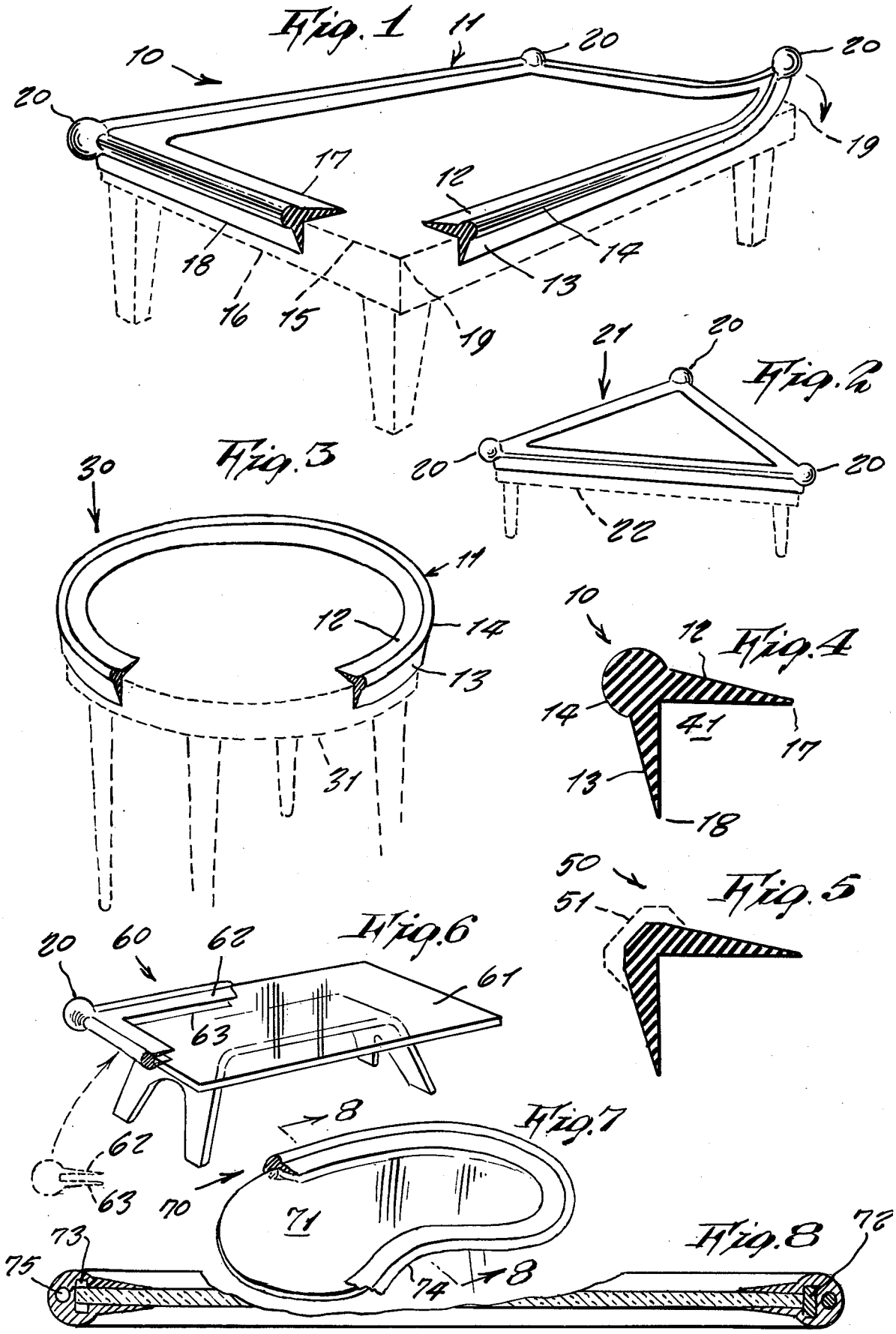

Referring now to the drawing in greater detail, and more particularly to FIG. 1 thereof at this time, the reference numeral 10 represents a baby bumper, according to the present invention, which comprises a stretchable, soft rubber beading 11, that includes a horizontal flap 12 and a vertical flap 13, extending at right angle to each other, and which, at their junction, form an outwardly rounded bulge 14 of thicker mass, so as to have a greater cushioning effect adjacent a sharp edge 15 of a table 16, made of hard material, such as wood or the like. Each of the flaps tapers toward an end edge 17, so that the edge is relatively flush with the furniture surface. At each corner 19 of the furniture, the beading includes a spherical protusion 20, so as to provide a still greater, thick mass of soft rubber, so as to give an additional protection at this dangerous point of an item of furniture. Thus, the baby bumper 10 is provided with four such spherical protrusions, in order to fit a rectangular table.

In FIG. 2, a baby bumper 21 is the same as above described baby bumper 10, except that it incorporates only three spherical-shaped protrusions 20 at its corners, in order to fit triangular-shaped tables 22.

In FIG. 3, a baby bumper 30 is shown, and which is designed for a table 31 having no corners, so that it may be either round, oval or other equivalent shape. In such instance, the baby bumper does not include any of the spherical protrusions 20 above described, but includes only the horizontal flap 12, the vertical flap 13 and the edge bulge 14.

As clearly shown in FIG. 4, the included corner 41, between the horizontal and vertical flaps, is square in shape, so as to fit the average conventional furniture tabletop, wherein the top surface thereof is perpendicular to a side of the same.

In FIG. 5, the baby bumper 50 is generally the same as the above described baby bumper 10, except that instead of the bulge 14 described above, the baby bumper 50 includes a thicker construction 51, this design of baby bumper being particularly adaptable for round or oval tables.

In FIG. 6, another design of baby bumper 60 is shown, for framing plate glass tabletops 61, by including parallel upper and lower horizontally extending flaps, 62 and 63, respectively. Vertical corner protrusions 20 may be included, if the plate glass 61 has corners.

If the plate glass has no corners, as shown in FIG. 7, the spherical protrusions 20 are not included. The plate glass tabletop 71, shown in FIG. 7, is irregularly shaped, such as for a kidney-shaped coffee table. In order that a baby bumper can be stretched around the plate glass periphery, and maintain to hug the plate glass edge even along its inwardly arcuate curve, the baby bumper 70, shown in FIGS. 7 and 8, includes a stiffener 72, imbedded within the interior thereof, the stiffener being made of a non-flexible steel bar, or the equivalent, and which is insertable into a slot 73 provided therefor. Accordingly, as shown in FIG. 8, such stiffener is provided only along the inwardly curve 74. Alternately, if the stiffener 72 is not employed, a hardening epoxy is poured into a central opening 75 formed in the baby bumper. After the epoxy hardens, it will maintain the stretchable beading in the desired shape.

While various changes may be made in the detail construction, it is understood that such changes will be within the scope and spirit of the present invention, as is defined by the appended claims.

What I now claim is:

1. A baby bumper, comprising, in combination, a beading made of a soft, stretchable rubber, said beading being extendible around a peripheral edge of furniture; said beading comprising a pair of elongated flaps, each of which, along one longitudinal edge, junctions with a longitudinal extending, transversely rounded bulge, each said flap tapering transversely toward its opposite longitudinal edge, a space between said flaps for said furniture peripheral edge being grasped therein by said flaps; spherical-shaped protrusions being formed along said beading, for positioning at corners of said furniture, said spherical protrusions each comprising an outwardly extending, thick mass of said soft rubber, that is larger than said bulge, so as to protrude further outwardly.

2. The combination as set forth in claim 1, wherein said rounded bulge has a longitudinally extending, central opening therethrough, said opening receiving a liquid epoxy having the characteristic of hardening subsequently.

* * * * *